US009437174B2

(12) United States Patent
Shamchuk

(10) Patent No.: US 9,437,174 B2
(45) **Date of Patent: *Sep. 6, 2016**

(54) MAGNETIC GUITAR SLIDE HOLDER

(71) Applicant: David Alex Shamchuk, Edmonton, Alberta (CA)

(72) Inventor: David Alex Shamchuk, Edmonton, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/822,717

(22) Filed: Aug. 10, 2015

(65) Prior Publication Data

US 2015/0348517 A1 Dec. 3, 2015

Related U.S. Application Data

(63) Continuation-in-part of application No. 14/256,951, filed on Apr. 19, 2014, now Pat. No. 9,105,257.

(60) Provisional application No. 61/820,744, filed on May 8, 2013.

(51) Int. Cl.
*G10D 3/00* (2006.01)
*G10D 1/08* (2006.01)

(52) U.S. Cl.
CPC . *G10D 3/00* (2013.01); *G10D 1/08* (2013.01)

(58) Field of Classification Search
CPC . G10D 3/163; G10D 3/043; B29C 45/14467
USPC ..... 84/320–322
See application file for complete search history.

(56) References Cited

U.S. PATENT DOCUMENTS 5,739,445 A * 4/1998 Terry ..... G10D 3/00 224/183
9,105,257 B2 * 8/2015 Shamchuk ..... G10D 3/00

OTHER PUBLICATIONS www.wedgie.com, Petersen et al, Mix 28.10, Sep. 2004.*

* cited by examiner

*Primary Examiner* — Kimberly Lockett
(74) *Attorney, Agent, or Firm* — Steven N. Fox, Esq.

(57) ABSTRACT

The present invention is a slide holder for use with a guitar having a headstock and a plurality of strings to support a slide. The slide holder comprises a block having a cavity and a magnet disposed in the cavity. The housing is made from a compressible material so the slide holder can be secured between the headstock and the strings of the guitar. A slide may be magnetically secured to the strings of the guitar thereby providing a support for the slide when not used.

20 Claims, 5 Drawing Sheets

MAGNETIC GUITAR SLIDE HOLDER

CROSS-REFERENCE TO RELATED APPLICATIONS

This application claims priority to and is a continuation-in-part of U.S. Utility patent application Ser. No. 14/256,951 filed on Apr. 19, 2014, now pending, which claims priority to U.S. Provisional Application Ser. No. 61/820,744 filed on May 8, 2013, both of are hereby incorporated into this specification by reference in their entirety.

BACKGROUND OF THE INVENTION

FIG. 1 shows a conventional guitar 10 having a neck 12, a headstock 14, a plurality of tuning pegs 16, a nut 18, a plurality of strings 20, and a plurality of frets 22. FIG. 2 shows a conventional metal slide 30 in the shape of a cylinder. Slide 30 has open ends so the player's finger may be inserted into either end as desired. The notes on guitar 10 are selected when a player depresses one of the strings 20 using a finger applied against one of the frets 22. String 20 contacts fret 22 and the pitch is increased to sound the desired note. An alternative method of playing a note at the desired pitch is to use a slide 30. This is a cylinder made of metal, glass or ceramic that is worn over the player's finger. The player contacts neck 12 at the desired position with slide 30 to achieve the desired pitch without necessarily contacting frets 22. This method of play offers unique sounds, not achievable with finger contact on frets 22. Slide 30 is somewhat awkward and can be difficult to put on and remove while playing. This is sometimes required, as parts of a song, which may or may not require this technique of play. While slide 30 is being worn, the finger wearing slide 30 cannot be used to depress strings 20 on frets 22 and use of this finger is lost. An expedient means of wearing and removing slide 30 is of value to the guitarist.

SUMMARY OF THE INVENTION

The present invention is a slide holder for use with a guitar having a headstock and a plurality of strings to support a slide. The slide holder comprises a block having a cavity and a magnet disposed in the cavity. The housing is made from a compressible material so the slide holder can be secured between the headstock and the strings of the guitar. A slide may be magnetically secured to the strings of the guitar thereby providing a support for the slide when not used.

BRIEF DESCRIPTION OF THE DRAWINGS

The following description of the invention will be further understood with reference to the accompanying drawings, in which.

DESCRIPTION OF THE INVENTION

Figure 1:
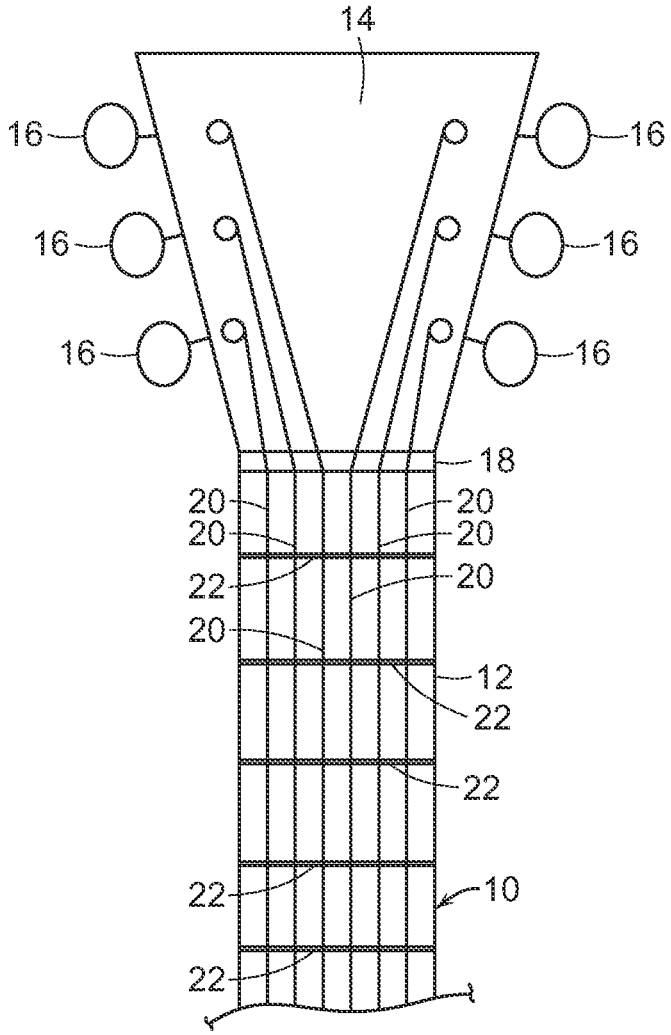
(PRIOR ART) FIG. 1
FIG. 1 is a top view of a conventional guitar having a neck, a headstock and a plurality of strings.
Figure 2:
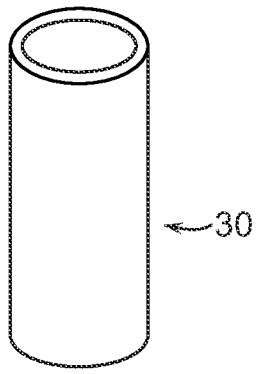
(PRIOR ART) FIG. 2
FIG. 2 is a perspective view of a conventional slide.
Figure 3:
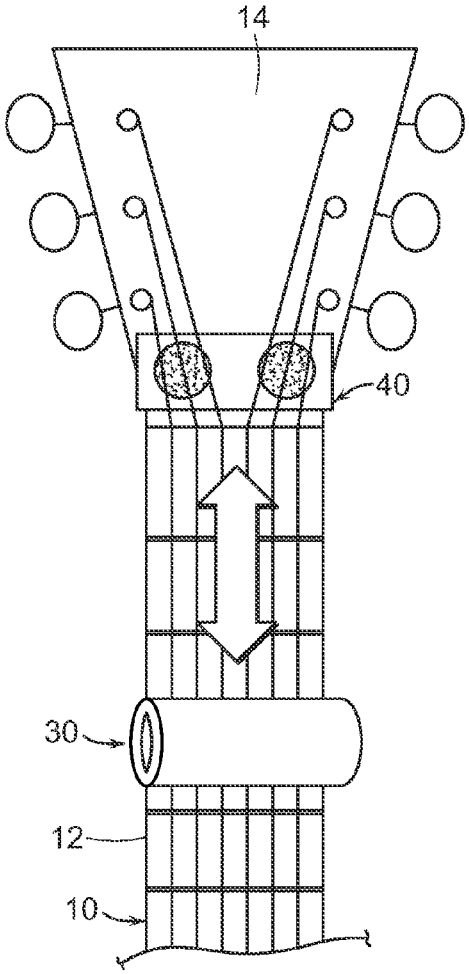
FIG. 3 is a perspective view showing a slide holder according to the present invention mounted on the headstock and under the strings of the guitar.

Referring to FIG. 3, a slide holder 40 according to the present invention is shown removably secured on a headstock 14 of a guitar 10. Slide holder 40 is adapted to be inserted on headstock 14 just above nut 18 and below strings 20. Slide holder 40 is further adapted to removably secure a slide 30 when desired by the player of guitar 10.

Figure 4:
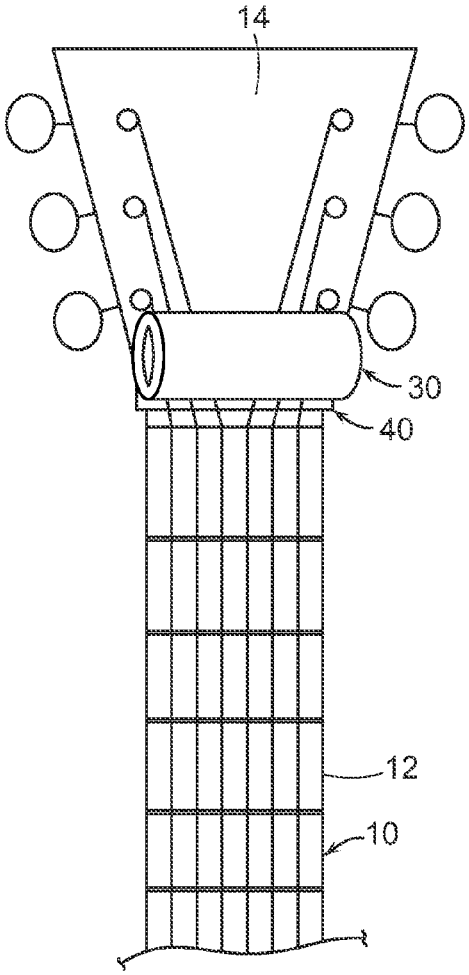
FIG. 4 is a perspective of the slide holder mounted on the headstock and under the strings of the guitar and a slide secured to and/or engaged with the strings directly above the slide holder.

Referring to FIG. 4, slide 30 is shown removably secured and/or engaged with strings 20 directly above slide holder 40 disposed on headstock 14 of guitar 10.

Figure 5:
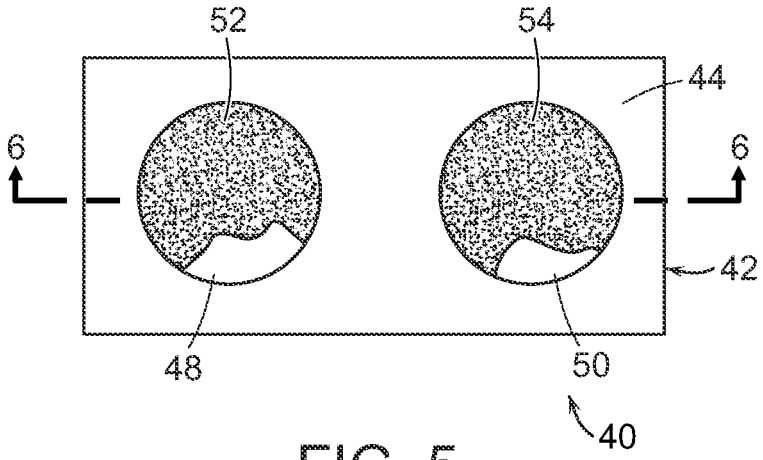
FIG. 5 is a top view of the slide holder.
Figure 6:
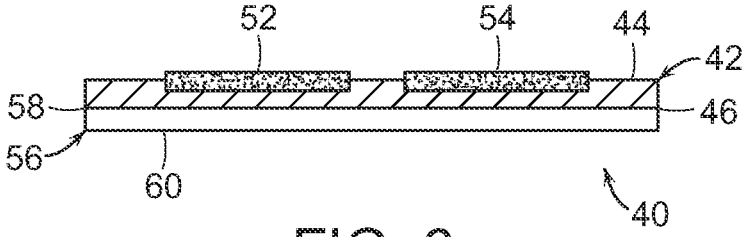
FIG. 6 is a cross section view of the slide holder taken along line 6-6 of FIG. 5.

Referring to FIGS. 5 and 6, slide holder 40 generally comprises a housing 42, magnets 52 and 54, and a removable adhesive pad 56. Housing 42 generally comprises a top surface 44, a bottom surface 46, a first cavity 48 and a second cavity 50 extending inward from top surface 44. Housing 42 is made from a compressible and resilient EVA foam available under the brand name POLYCELL from MDI Products, LLC, 10045 102nd Terrace, Sebastian, Fla. 32958 (www.mdiproducts.com), and fabricated by well known injection molding processes. In the embodiment shown, housing 42 is rectangular shaped. In other embodiments, housing 42 may take different shapes such as a circular shape. The compressibility and resiliency of the compressible material of housing 42 allows it to be secured under a force between the headstock 14 and strings 20.

Magnet 52 is secured in first cavity 48 by a conventional liquid adhesive. Similarly, magnet 54 is secured in second cavity 50 by a conventional liquid adhesive. Slide 30 is made of metal is removably attracted to magnets 52 and 54 of slide holder 40 as desired by the player of guitar 10. Magnets 52 and 54 have a sufficient magnetic field strength to secure slide 30 to or upon strings 20. In the embodiment shown, magnets 52 and 54 are neodymium magnets available from K&J Magnetics, Inc., 18 Appletree Lane, Pipersville, Pa. 18947 (www.kjmagnets.com). Although magnets 52 and 54 have been illustrated, slider holder 40 may comprise a single magnet of circular or rectangular shape or more than two magnets of different shapes. Alternatively, magnets 52 and 54 may be molded as part of housing 42.

Adhesive pad 56 is a double sided self-adhering stick pad made with nano-suction cups that can be secured to the surface of headstock 14 which is typically made of wood with a polymer thin film coating, ceramic, metal and/or a combination thereof. Adhesive pad 56 comprises a top surface 58 removably secured to bottom surface 46 of housing 42 and a bottom surface 60 that is secured to headstock 14. Adhesive pad 56 is well known and available from under the brand name STICK UM! from UM-BRANDS.COM, 13931 Central Avenue, Chino, Calif. 91710 (www.um-brands.com).

Figure 7:
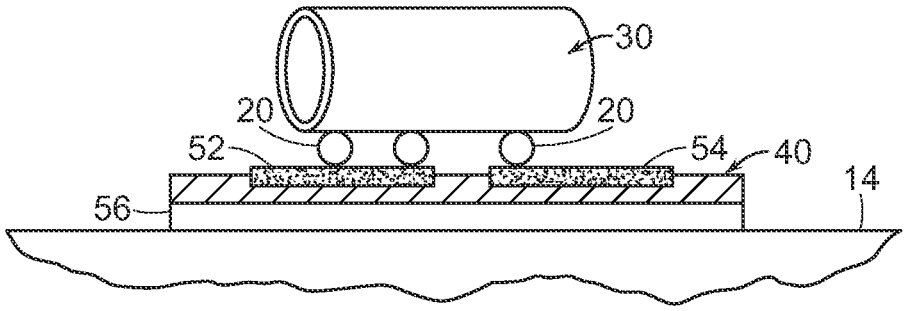
FIG. 7 is a cross section view showing the slide secured to and/or engaged upon the strings of the guitar directly above the slide holder mounted upon the head of the guitar.

Referring to FIG. 7, slide holder 40 is positioned under strings 20 and on headstock 14 of guitar 10. It is critical that slide holder 40 have an overall height in the range of 0.375 to 0.500 inches which allows slide holder 40 to be inserted on headstock 14 and under strings 20 of guitar 10. The compressibility of housing 42 provides height adjustment for insertion of slider holder 40 upon headtsock 14. Adhesive pad 56 stabilizes the position of slide holder 40 in relation to strings 20 and diminish any motion when in use. When slide 30 is placed in proximity to magnets 52 and 54 and released by the player, it remains suspended in a ready position under the magnetic field produced by magnets 52 and 54. The orientation and position are very favorable for reuse. When needed, the player inserts their finger into slide 30 and exerts enough force to remove it from the magnetic field of magnets 52 and 54. The strategic location and ease of movement on and off the finger make slide holder 40 a very useful tool.

Figure 8:
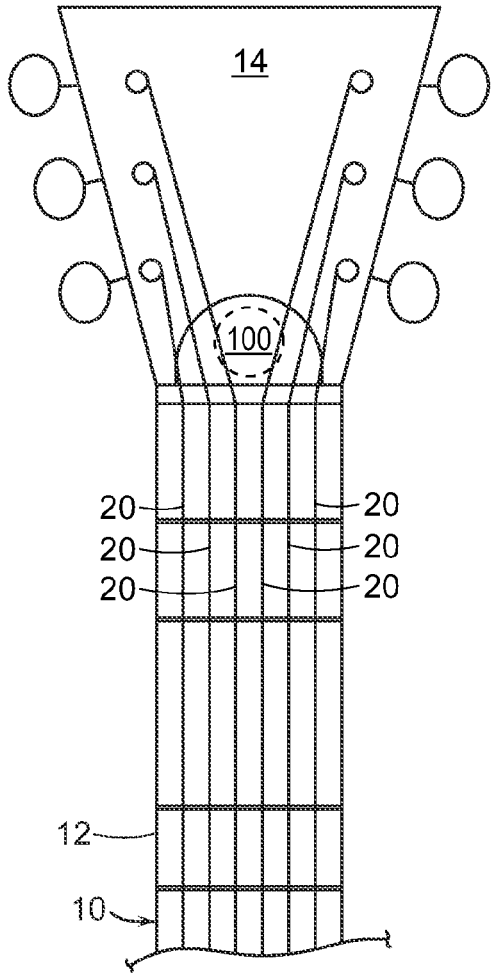
FIG. 8 is a top view of another embodiment of a slide holder according to the present invention mounted on the headstock and under the strings of the guitar.
Figure 9:
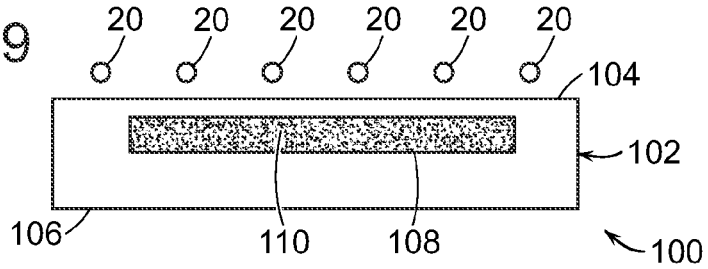
FIG. 9 is a front view of the slide holder showing a cavity and with a magnetic disposed therein.
Figure 10:
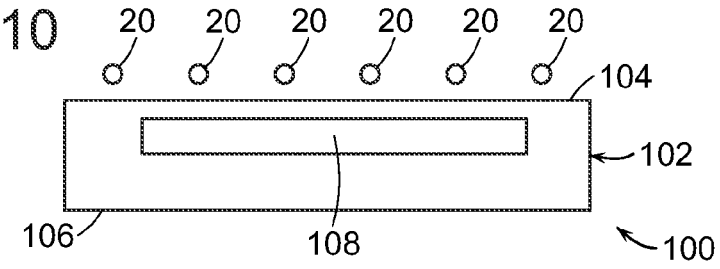
FIG. 10 is a front view of the slide holder showing a cavity without a magnetic disposed therein.

Referring to FIGS. 8-10, where a slide holder 100 according to another embodiment of the present invention is removably secured on headstock 14 of guitar 10 and below strings 20. Slider holder 100 comprises a housing or block 102 made from a compressible and resilient material such as foam. Housing 102 comprises a top surface 104, a bottom surface 106, and a cavity 108. Slide holder 100 further comprises a magnet 110 disposed in cavity 108. It is critical that block 102 have an overall height in the range of 0.250 to 0.750 inches which allows slide holder 100 to be inserted on headstock 14 and under strings 20 of guitar 10. The compressibility and resiliency of the compressible material of housing 102 allows it to be secured under a force between the headstock 14 and strings 20 along top surface 104 and bottom surface 106.

Figure 11:
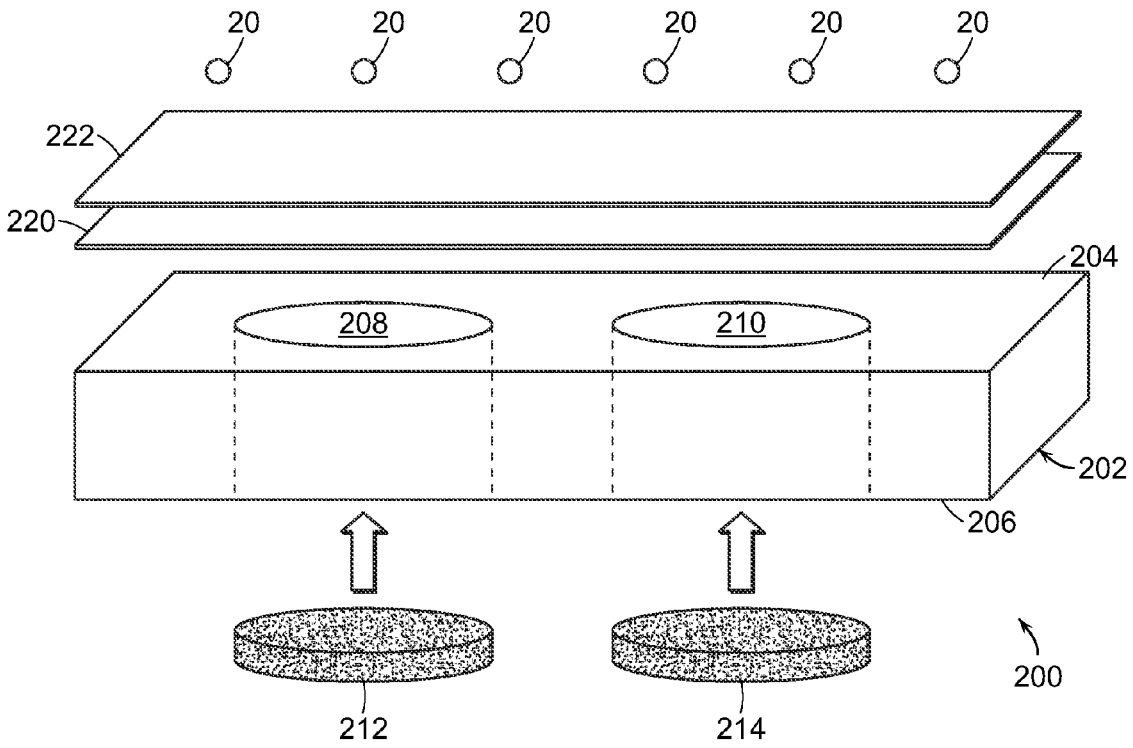
FIG. 11 is an exploded view of another embodiment of a slide holder according to the present invention mounted on the headstock and under the strings of the guitar.
Figure 12:
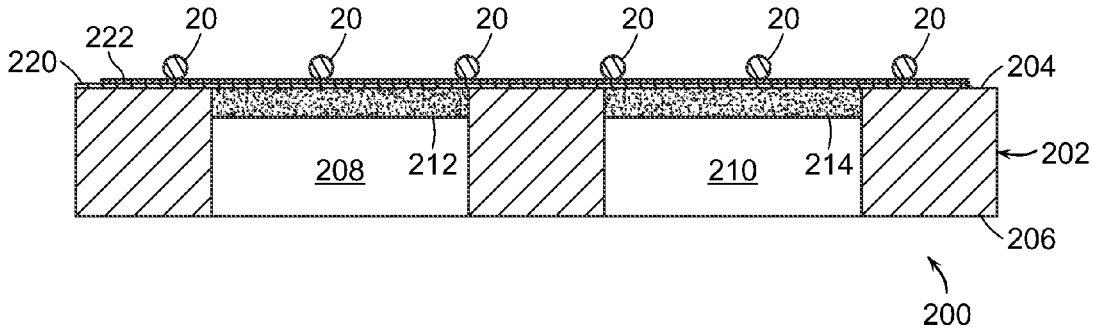
FIG. 12 is a cross section view of the slide holder showing first and second magnets disposed in first and second cavities formed in the foam body of the slide holder.

Referring to FIGS. 11 and 12, where a slide holder 200 according to another embodiment of the present invention comprises a housing or block 202 made from a compressible and resilient material such as foam. Block 202 comprises a top surface 204, a bottom surface 206, a first cavity or hole 208 extending from top surface 204 to bottom surface 206, and a second cavity or hole 210 extending from top surface 204 to bottom surface 206. Slide holder 200 further comprises a first magnet 212 disposed in first cavity 208 and a second first magnet 214 disposed in second cavity 210. It is critical that block 202 have an overall height in the range of 0.250 to 0.750 inches which allows slide holder 200 to be inserted on headstock 14 and under strings 20 of guitar 10. The compressibility and resiliency of the compressible material of housing 202 allows first and second magnets 212 and 214 to be secured within first and second cavity 208 and 210 without any adhesive such as glue or any other securing means. Slider holder 200 further comprises a plurality of strong thin non-metallic membrane layers 220 and 222 disposed upon top surface 204 of block 202. Membrane layers 220 and 222 prevent first and second magnets 212 and 214 from being pulled out off first and second cavity 208 and 210, respectfully, as metal slide 30 (FIG. 7) is pulled off of strings 20. Membrane layers 220 and 22 can be made from any non-metal material such as plastic. The compressibility and resiliency of the compressible material of foam block 202 allows it to be secured under a force between headstock 14 and strings 20 along top surface 204 and bottom surface 206.

The foregoing description is intended primarily for purposes of illustration. This invention may be embodied in other forms or carried out in other ways without departing from the spirit or scope of the invention. Modifications and variations still falling within the spirit or scope of the invention will be readily apparent to those of skill in the art.

What is claimed:

1. A slide holder for use with a guitar having a headstock and strings to support a slide, the slide holder comprising:

a block made from a compressible material to secure said block between the headstock and the strings of the guitar; and a first magnet disposed in said block; said first magnet magnetically secures the slider to the strings of the guitar upon placement of said block between the headstock and the strings.

2. The slider holder of claim 1, wherein said block comprises a top surface, a bottom surface, and a first cavity extending from said top surface to said bottom surface.

3. The slide holder of claim 2, wherein said first magnet is disposed in said first cavity.

4. The slide holder of claim 3, wherein said block comprising a second cavity extending from said top surface to said bottom top surface.

5. The slide holder of claim 4, further comprising a second magnet disposed in said second cavity.

6. The slide holder of claim 5, wherein said block has a height in the range of 0.250 to 0.750 inches to allow said housing to be inserted between the headstock and the strings of the guitar.

7. The holder of claim 6, wherein each of said first and second magnets are circular shaped.

8. The slide holder of claim 7, wherein said block is rectangular shaped.

9. The slide holder of claim 8, wherein each of said first and second magnets are substantially flat.

10. The slide holder of claim 9, wherein said block is made from a substantially solid piece of foam material.

11. A slide holder for use with a guitar having a headstock and strings to support a slide, the slide holder comprising:

a block made from a compressible material to secure said block between the headstock and the strings of the guitar; said block comprises a top surface, a bottom surface, and a first cavity extending from said top surface to said bottom surface; and a first magnet disposed in said first cavity of said block; said first magnet magnetically secures the slider to the strings of the guitar upon placement of said block between the headstock and the strings.

12. The slide holder of claim 11, wherein said block comprising a second cavity extending from said top surface to said bottom top surface.

13. The slide holder of claim 12, further comprising a second magnet disposed in said second cavity.

14. The slide holder of claim 13, wherein each of said first and second magnets are circular shaped.

15. The slide holder of claim 14, wherein said housing is rectangular shaped.

16. The slide holder of claim 15, wherein each of said first and second magnets are substantially flat.

17. The slide holder of claim 16, wherein said block is made from a substantially solid piece of foam material.

18. The slide holder of claim 17, wherein said block has a height in the range of 0.250 to 0.750 inches to allow said housing to be inserted between the headstock and the strings of the guitar.

19. The slide holder of claim 11, further comprising a membrane layer engaged with said top surface of said block.

20. The slide holder of claim 19, wherein said membrane layer is made from plastic.

* * * * *